US012490870B2

(12) United States Patent
Morris et al.

(10) Patent No.: US 12,490,870 B2
(45) Date of Patent: Dec. 9, 2025

(54) INFANT SHOWER HAMMOCK SYSTEM

(71) Applicants: Monayia Morris, Willingboro, NJ (US); Keenan Everett, Willingboro, NJ (US)

(72) Inventors: Monayia Morris, Willingboro, NJ (US); Keenan Everett, Willingboro, NJ (US)

( * ) Notice: Subject to any disclaimer, the term of this patent is extended or adjusted under 35 U.S.C. 154(b) by 0 days.

(21) Appl. No.: 18/619,424

(22) Filed: Mar. 28, 2024

(65) Prior Publication Data

US 2024/0324827 A1 Oct. 3, 2024

Related U.S. Application Data

(60) Provisional application No. 63/492,557, filed on Mar. 28, 2023.

(51) Int. Cl.
*A47K 3/28* (2006.01)
*A47D 13/08* (2006.01)

(52) U.S. Cl.
CPC ..... *A47K 3/282* (2013.01); *A47D 13/08* (2013.01)

(58) Field of Classification Search
CPC ..... A47K 3/282
See application file for complete search history.

(56) References Cited

U.S. PATENT DOCUMENTS

| | | | | | |
|---|---|---|---|---|---|
| 1,726,753 | A * | 9/1929 | Mirkin | A47K 3/164 | D23/278 |
| 2,245,951 | A * | 6/1941 | Agee | A47K 3/282 | 248/240.4 |
| 2,645,782 | A * | 7/1953 | Kennedy | A47K 3/064 | 4/572.1 |
| 5,337,525 | A * | 8/1994 | Zaccai | A47K 3/281 | 4/578.1 |
| 5,406,655 | A * | 4/1995 | Sahlin | A47K 3/064 | 5/655 |
| 9,055,847 | B1 * | 6/2015 | Flannery | A47C 4/283 | |

* cited by examiner

*Primary Examiner* — Christine J Skubinna
(74) *Attorney, Agent, or Firm* — Stuart M Goldstein

(57) ABSTRACT

An infant shower hammock system has a shower hammock section with a collapsible frame with dual interconnected support members. Each support member has an upper bar component and leg components extending down from the upper bar components. A durable flexible netting extends between the two support members to support the infant. A shower head bracket holder is attached to one of the upper bar components for securing a handheld shower nozzle. A detachable stool seat section comprises a stool seat connected by a horizontal stool seat support arm, extending between the seat and the frame. A vertical stool seat support with support legs is connected to and extends down from the stool seat.

3 Claims, 4 Drawing Sheets

INFANT SHOWER HAMMOCK SYSTEM

RELATED APPLICATION

This application claims the benefit of provisional application Ser. No. 63/492,557 filed on Mar. 28, 2023.

BACKGROUND OF THE INVENTION

There are currently a wide variety of devices which are utilized to bath infants. Most of these comprise flexible support members which are designed to be positioned and supported over bathtubs or sinks. Examples of these commonly used systems are disclosed in U.S. Pat. Nos. 2,933,735 and 5,722,100. Other known infant bathing devices use flexible cloth or like receptacles supported by framing, as exemplified by U.S. Pat. Nos. 2,162,483 and 2,644,953. However, while all these prior systems are generally directed to bathing infants in tub type devices, none disclose or contemplate the use of a shower for this purpose. All the prior art devices require the individual who does the bathing to stand and awkwardly bend over, and usually get wet in the process. Many of these devices are also heavy or cumbersome to set-up and not easily transported. A lightweight, portable device which is specifically designed to be used in the shower would not only be more effective in cleaning the infant, but would also assist the individual doing the washing to more efficiently, quickly, and comfortably complete the task.

SUMMARY OF THE INVENTION

It is thus the object of the present invention to provide an infant shower hammock system designed specifically to be used to efficiently wash and clean an infant in a shower and allow the individual washing the infant to be comfortably seated and remain dry during the washing process.

These and other objects are accomplished by the present invention, a self-contained infant shower hammock system comprising a shower hammock section having a collapsible frame with dual interconnected support members. Each support member has an upper bar component and leg components extending down from the upper bar components. A durable flexible netting extends between the two support members to support an infant. A shower head bracket holder is attached to one of the upper bar components for securing a handheld shower head. A detachable stool seat section comprises a stool seat connected by a horizontal stool seat support arm, extending between the seat and the frame. A vertical stool seat support with support legs is connected to and extends down from the stool seat support to the ground.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

DETAILED DESCRIPTION OF THE INVENTION

Figure 1:
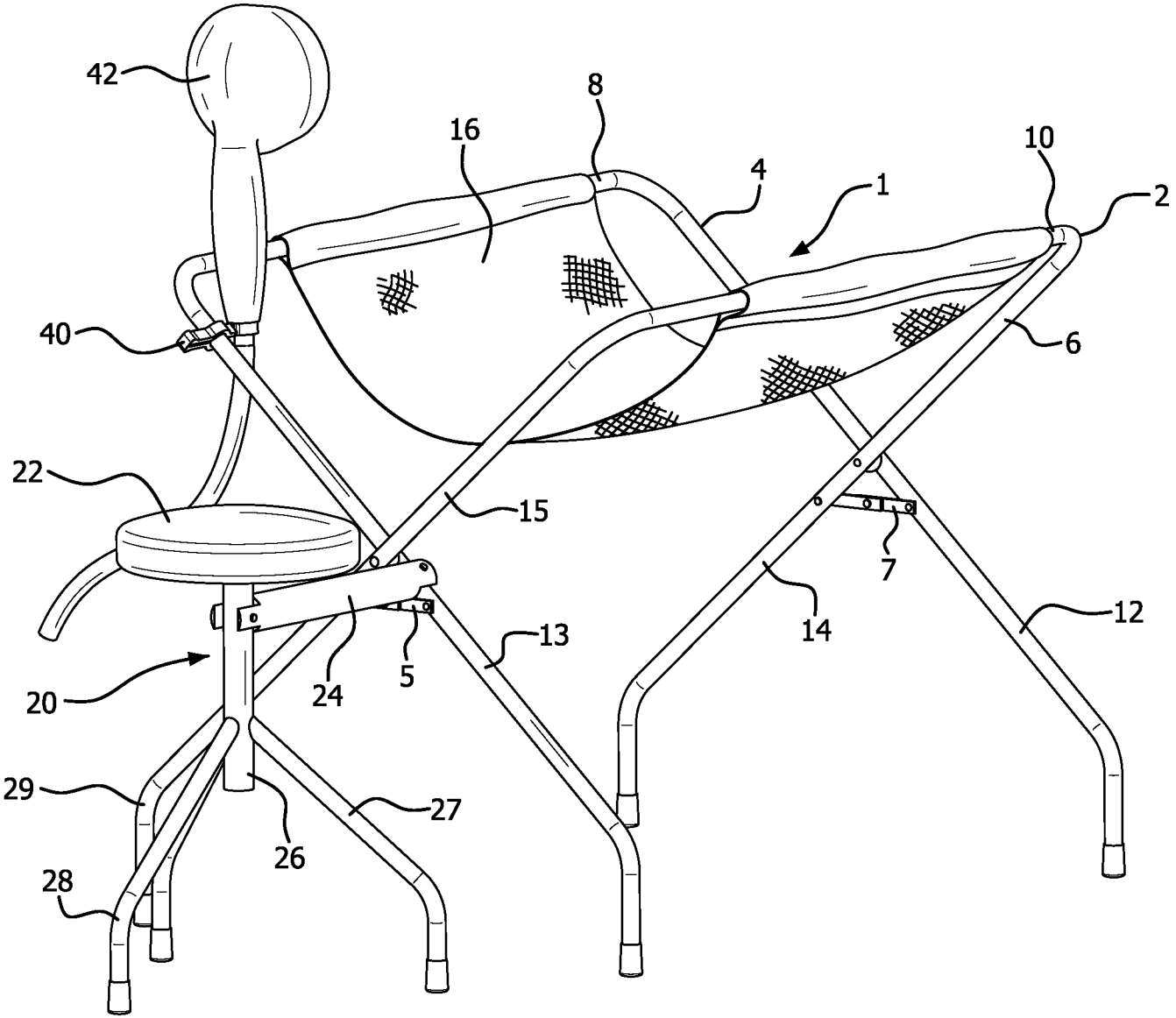
FIG. 1 is a perspective view of the assembled shower hammock system of the present invention in its use position.
Figure 2:
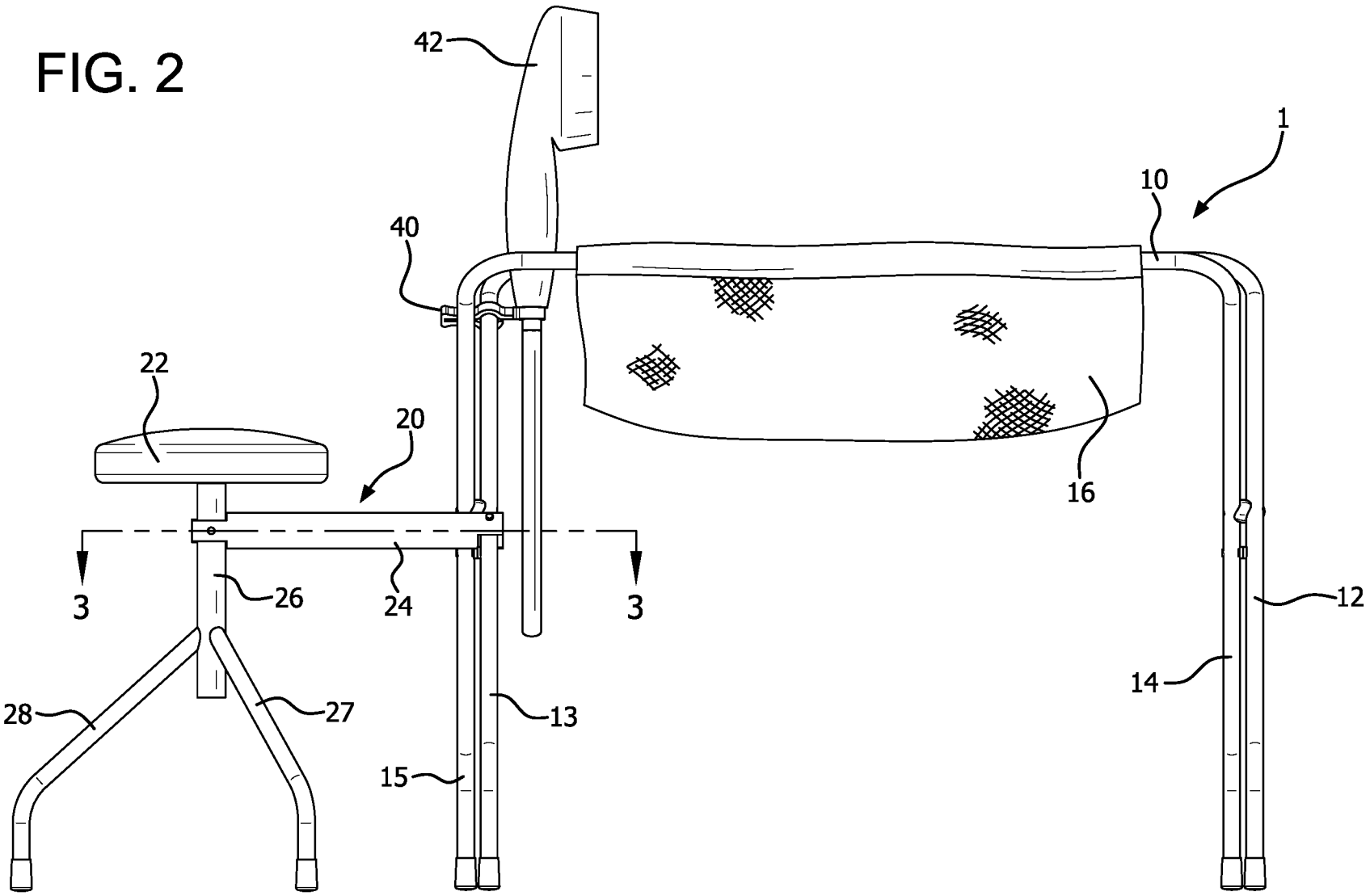
FIG. 2 is an elevation view of the assembled shower hammock system of the present invention in its use position.
Figure 3:
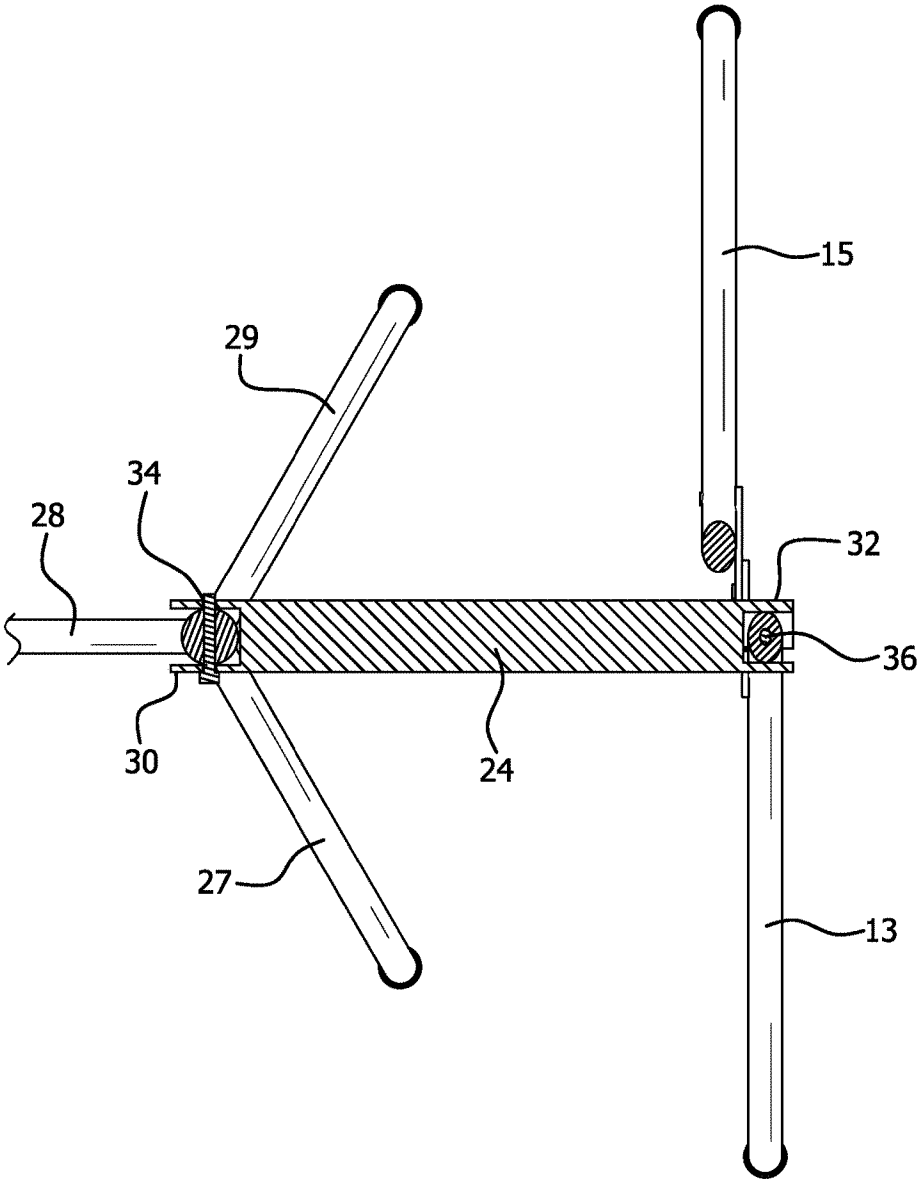
FIG. 3 is a sectional view taken from FIG. 2.

The infant shower hammock system of the present invention, shown in FIG. 1 in its fully open, use position, comprises shower hammock section 1 and stool seat section 20. Shower hammock section 1 comprises hammock frame 2 with support members 4 and 6 interconnected by hinges 5 and 7. Each support member comprises an upper bar component 8 and 10 and leg components 12 and 13 and 14 and 15, each extending down from their respective upper bar component. Flexible hammock netting 16 extends between and is adjoined to bar components 8 and 10 of support members 4 and 6.

Detachable stool seat section 20 comprises stool seat 22, horizontal stool seat support arm 24, and vertical stool seat support 26 with support legs 27, 28, and 29. Stool seat support leg 26 extends down from stool seat 22. Stool seat support arm 24 is detachably connected at one of its ends to leg component 13 of hammock frame 2 and at its other end is detachably connected to stool seat support 26. Stool seat support arm 24 is detachably connected to leg component 13 and stool seat support 26 by U-shaped collars 30 and 32 and corresponding bolts 34 and 36. While this means of connection is disclosed, it is contemplated that any known connection means, e.g. push button connections, screw attachments, etc., can be utilized. Shower head support bracket 40 is attached to leg component 13 for holding shower head 42.

Figure 4:
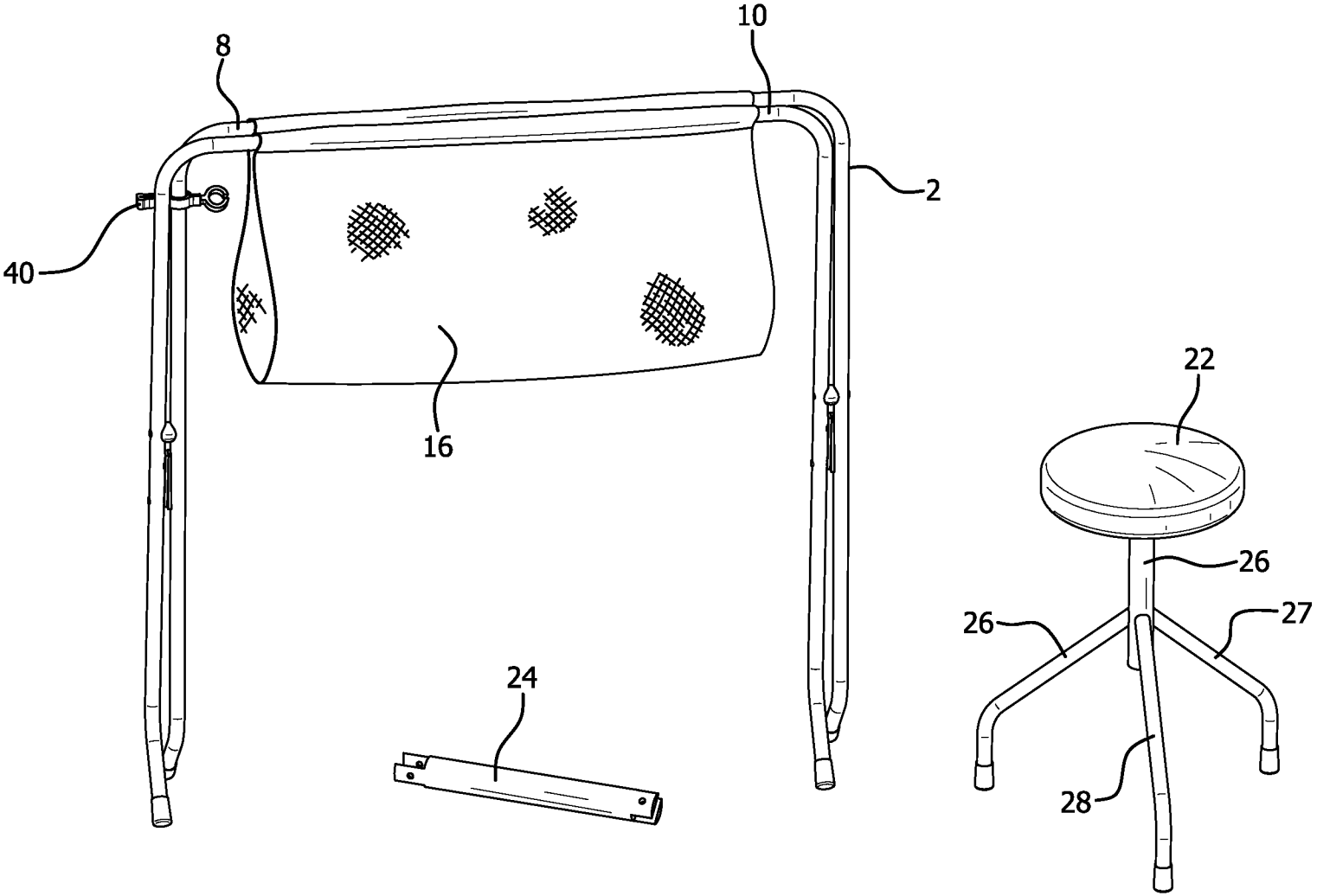
FIG. 4 shows the disassembled components of the shower hammock system of the present invention.

In use, infant shower hammock section 1 is taken from its stored position in which hammock frame 2 is closed with upper bar components 8 and 10 adjacent to each other and netting 16 is folded between the bar components, as shown in FIG. 4. Hammock frame 2 is then opened to its use position, as shown in FIG. 1, in which bar components 8 and 10 are spread apart and netting 16 is spread out between the bar components. Stool section 20 is assembled by attaching one end of stool seat support arm 24 to stool seat support 26 by means of U-shaped collar 30 and bolt 34. The other end of stool seat support arm 24 is then attached to leg component 13 of hammock frame 2 by means of U-shaped collar 32 and bolt 36. When fully assembled, shower hammock section 1 can then be placed in a bathtub, with stool seat section 20 located outside the bathtub. The infant can then be placed in netting 16, washed and rinsed via the bathtub's shower using shower head 42 removed from bracket 40, while the individual doing the washing is seated on stool seat 22, comfortable and dry, outside the bathtub.

The present invention provides a unique infant washing system which provides the infant washer convenience and comfort while attending to the cleaning needs of the infant. As an added benefit, the present invention is collapsible and has readily detachable lightweight components which makes it easy to store and very portable.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An infant shower hammock system comprising:

a shower hammock section having a hammock frame comprising two interconnected support members, each support member having an upper bar component and leg components extending down from the upper bar component, and a flexible hammock netting extending between and adjoined to the two support members, wherein in a storage position the hammock frame is closed with its upper bar components adjacent to each other and the netting folded between the upper part components, and in a use position the frame is open with its upper bar components spread apart with the netting spread out therebetween; and a detachable stool seat section comprising a stool seat, a horizontal stool seat support arm having two ends and a vertical stool seat support having support legs, the stool seat support extending down from the stool seat, wherein the stool seat support arm is detachably connected at one of its ends to the hammock frame and at its second end is detachably connected to the stool seat support.

2. The infant shower hammock system as in claim 1 wherein the stool seat support arm is detachably connected to a leg component of the hammock frame and the stool seat support by U shaped collars and corresponding bolts.

3. The infant shower hammock system as in claim 1 wherein a shower head support bracket is connected to one of the upper bar components of the hammock frame.

* * * * *